US005498502A

United States Patent [19]

Muramoto et al.

[11] Patent Number: 5,498,502

[45] Date of Patent: Mar. 12, 1996

[54] NEGATIVE CHARGING TYPE PRINTING PHOTOSENSITIVE RESIN COMPOSITION

[75] Inventors: Hisaichi Muramoto, Hirakata; Kazunori Kanda, Yao; Yutaka Kanoi, Suita, all of Japan

[73] Assignee: Nippon Paint Co., Ltd., Osaka, Japan

[21] Appl. No.: 372,303

[22] Filed: Jan. 13, 1995

[30] Foreign Application Priority Data

Jan. 17, 1994 [JP] Japan ..... 6-003088

[51] Int. Cl.[6] ..... G03G 5/66; G03G 5/09; G03G 13/28

[52] U.S. Cl. ..... 430/49; 430/58; 430/77; 430/78; 430/83

[58] Field of Search ..... 430/49, 77, 78, 430/83, 58

[56] References Cited

U.S. PATENT DOCUMENTS

| | | | |
|---|---|---|---|
| 3,951,654 | 4/1976 | Mammino | 430/83 |
| 4,985,323 | 1/1991 | Yokoya et al. | 430/49 |
| 5,063,129 | 11/1991 | Yokoya et al. | 430/49 |
| 5,102,760 | 4/1992 | Yokoya et al. | 430/49 |
| 5,134,049 | 7/1992 | Kuroda et al. | 430/83 |
| 5,166,025 | 11/1992 | Kaieda et al. | 430/49 |

*Primary Examiner*—Richard L. Schilling
*Attorney, Agent, or Firm*—Wenderoth, Lind & Ponack

[57] ABSTRACT

The present invention provides an electrographic printing photosensitive resin composition, which exhibits a good photosensitivity in a negative corona charging system and is useful for a laser platemaking system using semi-conductor laser light within a near infrared range as a light source.

Disclosed is a negative charging type printing photosensitive resin composition comprising a phthalocyanine compound (a), a mercaptoarylimidazole (thiazole) compound (b) and, if necessary, a compound selected from the group consisting of a condensed polycyclic quinone compound, a bisazo compound, a cyanine compound, a quinacridone compound and a mixture thereof (d), said compounds being dispersed in a binder resin (c). A printing photosensitive resin plate using the photosensitive resin composition is also disclosed.

9 Claims, No Drawings

NEGATIVE CHARGING TYPE PRINTING PHOTOSENSITIVE RESIN COMPOSITION

DEFINITION OF TERMS

The term "resin plate" used herein means a plate on which a photosensitive resin composition is coated.

The term "printing plate" used herein is a plate having a relief image to be printed, which is obtained by subjecting a resin plate to an exposing and developing process.

1. Field of the Invention

The present invention relates to a photosensitive resin composition for printing, and a resin plate for printing using the same.

2. Background of the Invention

A platemaking method by means of an electrographic system is a method which comprises (i) forming a resin plate for lithographic printing composed of a substrate which has been subjected to a hydrophilization treatment by such a method as anodizing and a photosensitive layer formed on the substrate, wherein the photosensitive layer comprises a photoconductive substance (e.g. phthalocyanine compound, etc.) dispersed in a binder resin, (ii) uniformly charging a surface of the resin plate by corona charging, (iii) forming an electrostatic latent image corresponding to a digital signal from a computer, using a light source having a wavelength within a visible/near infrared range (e.g. argon laser having an oscillation wavelength at 488 nm, He-Ne laser having an oscillation wavelength at 633 nm or semiconductor laser having an oscillation wavelength at 780 nm), (iv) visualizing the latent image by toner, (v) fixing the toner image with heating, and (vi) eluting a non-imaging part with an aqueous alkali solution to give a printing plate. In this method, it is necessary to select a toner which is insoluble with the aqueous alkali solution. Further, it is preferred to use a wet toner having a small particle size which is superior in resolving power to a dry toner.

As the resin plate for lithographic printing by means of the electrographic system, Japanese Laid-Open Patent Publication No. 4(1992)- 212967 discloses a photosensitive composition which comprises an X-type metal-free phthalocyanine or titanyl phthalocyanine dispersed in a binder resin. The composition shows good photosensitivity in case of positive charging, but have not sufficient photosensitivity in case of negative charging and therefore it is far from practical application. Further, in case of negative charging, there is such a disadvantage that a dark decay rate is large and it is unstable.

However, a negative charging type resin plate have hitherto been used in this field. A representative example of such resin plate is one comprising a paper or polyester substrate and a photosensitive layer containing zinc oxide formed thereon. A resin plate suitable for the electrographic system in a negative corona charging system is more desirable.

For this purpose, it is necessary to use phthalocyanine as an organic semi-conductor having good photosensitivity enough to use most useful semi-conductor laser light as one of less expensive energy source.

OBJECTS OF THE INVENTION

One object of the present invention is to provide an electrographic printing photosensitive resin composition having a high sensitivity within a near infrared/visible range, which exhibits good photosensitivity in a negative corona charging system and can be applied to a laser platemaking system using semi-conductor laser light within a near infrared range as a light source. Another object of the present invention is to provide a printing resin plate using the same.

These objects as well as other objects and advantages of the present invention will become apparent to those skilled in the art from the following description.

SUMMARY OF THE INVENTION

The present invention provides a negative charging type printing photosensitive resin composition comprising:

(a) a phthalocyanine compound;

(b) at least one compound represented by the formula (I) or (II):

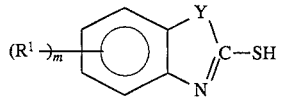

(I)

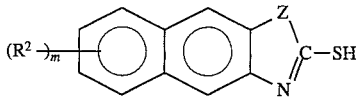

(II)

wherein Y and Z respectively indicate an imino group or a sulfur atom; $R^1$ and $R^2$ are the same or different and indicate a hydroxyl group, an alkyl group having 1 to 4 carbon atoms and a halogen atom; and m is an integer of 0 to 2; and (c) a binder resin.

The present invention also provides a negative charging type printing photosensitive resin composition which further comprises a compound selected from the group consisting of a condensed polycyclic quinone compound, a bisazo compound, a cyanine compound, a quinacridone compound and a mixture thereof (d), in addition to the above components (a), (b) and (c).

The present invention also provides a printing photosensitive resin plate using the photosensitive resin composition.

Japanese Laid-Open Patent Publication No. 63(1988)-276054 and Japanese Patent Publication No. 4(1992)-31574 suggest an electrophotosensitive material which contains an imidazole derivative having different chemical structure as a charge transferring substance in place of the above component (b). These materials do not contain a mercapto group in the molecular structure and can not exhibit a sufficient hole transferring function when using as the electrophotosensitive material. The present inventors have found that, a compound obtained by introducing a mercapto group into an arylimidazole compound or an arylthiazole compound, i.e. the group of compounds represented by the formula (I) or (II) which exhibits an extremely excellent charge transferring efficiency is suitably used in order to improve the hole transferring function to obtain a satisfactory photosensitivity required for electrophotosensitive materials, thus the present invention has been completed.

That is, the present invention provides a corona negative charging type printing photosensitive resin composition having a high photoconductivity by dispersing (a) a phthalocyanine compound and (b) at least one sort of a mercaptoarylimidazole compound or a mercaptoarylthiazole compound represented by the formula (I) or (II) into (c) a binder resin. Further, the present inventors have found that, by dispersing (d) a compound selected from the group consisting of a condensed polycyclic quinone compound, a bisazo compound, a cyanine compound, a quinacridone compound and a mixture thereof into (c) a binder resin together with the above components (a) and (b), adhesion properties of toner onto the non-printing part are inhibited (e.g. decrease in surface residual potential after exposure, etc.) and, after alkali-eluation, a more clear toner image can be obtained.

DETAILED DESCRIPTION OF THE INVENTION (Phthalocyanine compound (a))

In general, the phthalocyanine compound (a) used in the present invention is a metallic phthalocyanine and a metal-free phthalocyanine represented by the formula (IX):

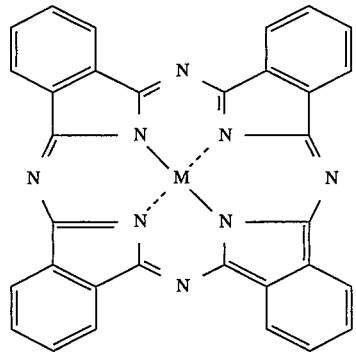

wherein M is hydrogen (2H) or a metal, which may have one or more substituent on the benzene rings.

As the metallic phthalocyanine, there can be used those which have various crystal forms (e.g. α,β,ε, m, π,ρ, χ, etc.) or an amorphous form and may also be substituted with a halogen atom or not. Examples of the metals coordinated in the center include copper, magnesium, zinc, aluminum, vanadium, molybdenum, manganese, iron, cobalt, nickel, titanium or an oxide thereof. Fluorinated zinc phthalocyanine of the following formula (III) is most preferred.

(III)

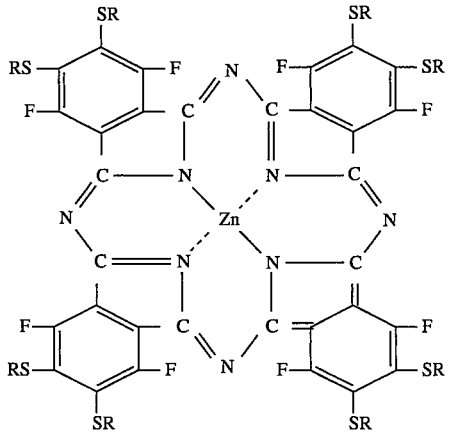

wherein R is an aryl group.

The aryl group may be a phenyl group or a naphthyl group, and the phenyl group may be substituted with an alkyl group having 1 to 4 carbon atoms.

As the fluorinated zinc phthalocyanine, various kinds are described in Japanese Laid-Open Patent Publication Nos. 4(1992)-73950. Further, the production process thereof is described in Japanese Laid-Open Patent Publication No. 64(1989)-45474. The Japanese Publications do not have any corresponding applications in English, but a similar application is EP-A- 0,523,959. The metal-free phthalocyanine preferably is an X-type crystal form.

The above phthalocyanine compounds generally have an absorption spectrum within a wavelength range of 780 to 830 nm which is emitted by a semi-conductor laser, and therefore useful in the present invention.

(Component (b))

The composition of the present invention contains the mercaptoarylimidazole or mercaptoarylthiazole (I) or (II)

(I)

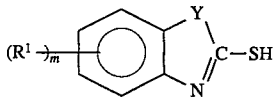

(II)

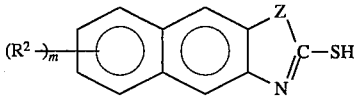

wherein Y and Z respectively indicate an imino group or a sulfur atom; $R^1$ and $R^2$ are the same or different and indicate a hydroxyl group, an alkyl group having 1 to 4 carbon atoms and a halogen atom; and m is an integer of 0 to 2.

Examples of the compounds (I) include mercaptobenzimidazole, mercaptomethylbenzimidazole, mercaptohydroxybenzimidazole, mercaptoiodobenzimidazole, mercaptochlorobenzimidazole, mercaptotetrahydroxybutylphenylimidazole, mercaptobenzothiazole, mercaptomethylbenzothiazole, mercaptohydroxybenzothiazole, mercaptoiodobenzothiazole, mercaptochlorobenzothiazole, mercaptotetrahydroxybutylphenylthiazole, mercaptohydroxybenzothiazole and the like.

Examples of the compounds (II) include mercaptonaphthoimidazole, mercaptochloronaphthoimidazole, mercaptohydroxynaphthoimidazole, mercaptomethylnaphthoimidazole, mercaptonaphthothiazole, mercaptoiodonaphthothiazole, mercaptohydroxynaphthothiazole, mercaptomethylnaphthothiazole and the like.

The composition of the present invention may be obtained by dispersing the above components (a) and (b) into the binder resin (c). In addition to the above components, the condensed polycyclic quinone compound component (d) can be added thereto to make an image clearer.

(Component (d))

The component (d) in the present invention is a compound selected from the group consisting of a condensed polycyclic compound, a bisazo compound, a cyanine compound, a quinacridone compound or a mixture thereof. The condensed polycyclic quinone compounds are compounds of the formulas (IV) to (VIII) or a mixture thereof.

(IV)

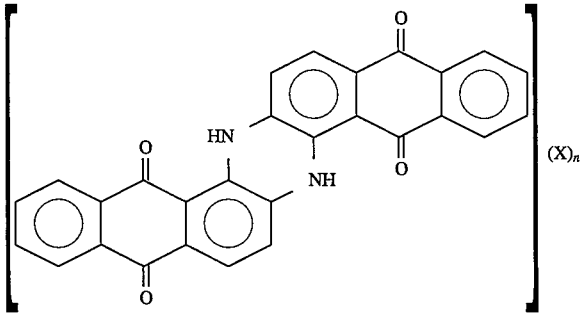

-continued (V)

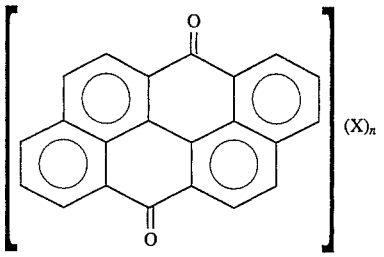

(VI)

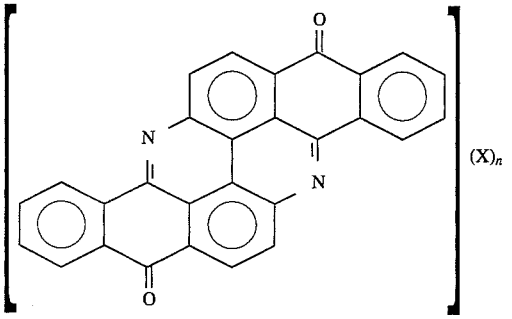

(VII)

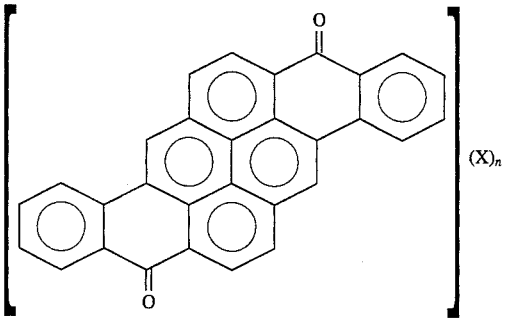

(VIII)

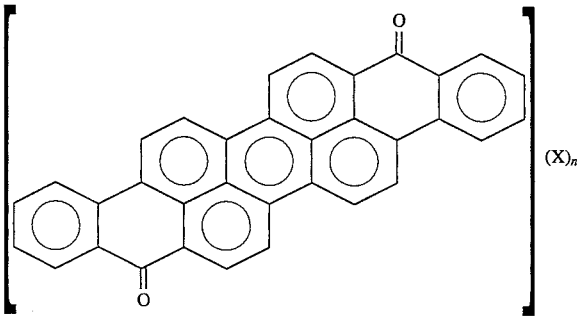

wherein X may be the same or different and indicates a halogen atom and n is an integer of 0 to 4.

Examples of the condensed polycyclic quinone of the formula (IV) include indanthrone, dichloroindanthrone, dibromoindanthrone, difluoroindanthrone and the like.

Examples of the condensed polycyclic quinone of the formula (V) include anzanthrone, dibromoanzanthrone, tetrabromoanzanthrone, dichloroanzanthrone, tetrachloroanzanthrone, difluoroanzanthrone, tetrafluoroanzanthrone and the like.

Examples of the condensed polycyclic quinone of the formula (VI) include flavanthrone, dicloroflavanthrone, tetrachloroflavanthrone, dibromoflavanthrone, tetrabromoflavanthrone, difluoroflavanthrone, tetrafluoroflavanthrone and the like.

Examples of the condensed polycyclic quinone of the formula (VII) include pyranthrone, dibromopyranthrone, tetrabromopyranthrone, dichloropyranthrone, tetrachloropyranthrone, difluoropyranthrone, tetrafluoropyranthrone and the like.

Examples of the condensed polycyclic quinone of the formula (VIII) include isoviolanthrone, dichloroisoviolanthrone, tetrachloroisoviolanthrone, dibromoisoviolanthrone, tetrabromoisoviolanthrone, difluoroisoviolanthrone, tetrafluoroisoviolanthrone and the like. Among the above condensed polycyclic quinone compounds, those which are preferably used are anzanthrones of the formula (V), flavanthrones of the formula (VI) and pyranthrones of the formula (VII).

Examples of the bisazo compound used in the present invention include those represented by the color index name, such as C.I. Disperse Yellow 7, C.I. Disperse Orange 13 and 21, C.I. Disperse Orange 14, C.I. Solvent Red 23, 24, 25 and 27, C.I. Solvent Black 3 and the like. Further, there can be used any bisazo compound described in Japanese Laid-Open Patent Publication Nos. 61(1986)-124951, 62(1987)-226156, 62(1987)-272272, 63(1988)-97965 (corresponding U.S. Pat. No. 4,859,555), 63(1988)-97966, 1(1989)-257862, 3(1991)-37656, 3(1991)-37658, 3(1991)-37665 and the like.

Examples of the quinacridone compound include the those represented by the color index name, such as C.I. Pigment Violet 19, C.I. Pigment Red 122 and the like.

Examples of the cyanine compound include 3,3'-diethyl-2,2'-oxatricarbocyanine iodide, 1,3,3,1',3',3'-hexamethyl-2,2'-indotricarbocyanine iodide, 3,3'-diethyl-2,2'-thiatricarbocyanine iodide, 3,3'-diethyl-2,2'-thiatricarbocyanine bromide, 3,3'-diethyl-2,2'-selenatricarbocyanine iodide, 1,3,3,1',3',3'-hexamethyl-2,2'-(4,5,4',5'-dibenzo)indotricarbocyanine perchloride, 3,3'-diethyl-2,2'-(4,5,4',5'-dibenzo)thiatricarbocyanine iodide, 1,1'-diethyl-2,2' -iodide, 1,1'-diethyl-4,4'-quinotricarbocyanine iodide, 3,3'-dimethyl-2,2'-oxatricarbocyanine iodide, 3,3'-diethyl-2,2'-oxatricarbocyanine perchlorate, 1,3,3,1',3',3'-hexamethyl-2,2'-indotricarbocyanine perchlorate, 3,3'-diethyl-2,2'-(6,7,6',7'-dibenzo)thiatricarbocyanine iodide, 3,3'-dioctadecyl-2,2'-thiacarbocyanine iodide, 3,3'-dioctadecyl- 2,2'-thiacarbocyanine perchlorate, 3,3'-dioctadecyl-2,2'-thiacyanine perchlorate, 1,1'-dioctadecyl-3,3,3',3'-tetramethylindocarbocyanine iodide, 3,3'-dioctadecyl-2,2'-oxacarbocyanine perchlorate, 3,3'-dioctadecyl-2,2'-oxacyanine perchlorate, 1,1'-dioctadecyl-3,3,3',3'-tetramethyl- 2,2'-indotricarbocyanine perchlorate, 1,1'-dioctadecyl-3,3,3',3'-tetramethyl- 2,2'-indodicarbocyanine perchlorate, 1,1'-dioctadecyl- 1,1'-bromo- 4,4'-quinocarbocyanine perchlorate, 1,1'-dioctadecyl-3,3,3',3'-tetramethyl-2,2'-( 4,5,4,5'-dibenzo)indodicarbocyanine perchlorate, 3,3'-(di-n-propyl)-2,2'-oxacarbocyanine iodide, 3,3'-(di-n-pentyl)-2,2'-oxacarbocyanine iodide, 3,3'-(di-n-hexyl)-2,2'-octacarbocyanine iodide, 3,3'-(di-n-propyl)-2,2'-oxadicarbocyanine iodide, 3,3'-(di-n-propyl)-2,2'-thiadicarbocyanine iodide, 1-carboxyethyl- 3'-ethyl-4,2'-quinothiadicarbocyanine iodide, 1,1 '-diethyl- 3,3,3',3'-tetramethyl-2,2'-indotricarbocyanine iodide and the like. Among the above compounds of the component (d), the most preferable compound which enables the present invention to exhibit its effect is the condensed polycyclic quinone compound alone or in combination with the other compound (d).

(Component (c))

The binder resin (c) used in the present invention is one in which the above components are sufficiently dispersed or dissolved. It is necessary that the binder resin is alkali-soluble such that the composition is exposed to light and the electrostatic image is developed with a toner and then the non-printing part is dissolved and removed with an aqueous alkali solution to prepare a printing plate.

In order to impart alkali-solubility to the binder resin, it is necessary that the resin contains hydrophilic functional groups such as hydroxyl group, acid anhydride group, carboxyl group, sulfonic group, phosphoric group or the like. The resin having the functional group include copolymers of vinyl monomers (e.g. styrene, methacrylate, acrylate, vinyl acetate, vinyl acetate, vinyl benzoate, etc.) and carboxylic acid-containing monomers (e.g. acrylic acid, methacrylic acid, itaconic acid, crotonic acid, maleic acid, fumaric acid, etc.) or dibasic acid monoester monomers; or copolymers of methacrylamide or vinyl pyrrolidone and monomers containing phenolic hydroxyl group, sulfonic group, phosphoric group; and the like. Typical examples of the binder resins are styrene/maleic acid copolymer resin, styrene/maleic acid monoester copolymer, (meth)acrylic acid/(meth)acrylate copolymer, (meth)acrylic acid/acrylate/methacrylate copolymer, styrene/(meth)acrylic acid/(meth-)acrylate copolymer, vinyl acetate/crotonic acid copolymer, vinyl benzoate/crotonic acid copolymer, vinyl acetate/crotonic acid/(meth)acrylate copolymer, and the like. Further, the binder resins described in Japanese Laid-Open Patent Publication Nos. 4(1992)-274428 and 4(1992)-258956 (corresponding to EP-A-0,501,834 and EP-A-0,499,447) may also be used. Among the above alkali-soluble binder resins, preferred is a resin having a glass transition temperature of not less than 40° C., an acid value of 50 to 300 and a number-average molecular weight of not less than 10,000. When the glass transition temperature is smaller than 40° C., the resin layer on the substrate becomes brittle, which results in insufficient printing wear resistance. When the acid value is smaller than 50, alkali-solubility becomes inferior. On the other hand, when it exceeds 300, alkali-solubility of the resin layer becomes too strong. As a result, side-etching is liable to be arisen, which results in deterioration of image quality. Further, since the resin layer becomes brittle in case of the oligomer having the number-average molecular weight of 10,000 or less, printing wear resistance becomes insufficient.

The total amount of the components (a) and (b) in the photosensitive layer is 5 to 70% by weight, preferably 15 to 40% by weight, based on 100% by weight of the components (a), (b) and (c). Further, the total amount of the components (a), (b) and (d) in the photosensitive layer is 5 to 70% by weight, preferably 15 to 40% by weight, based on 100% by weight of the components (a), (b), (c) and (d). When the amount of the components (a) and (b) or (a), (b) and (d) is smaller than 5% by weight, a sufficient amount of charge can not be obtained by corona discharge. Accordingly, a visible image having insufficient toner density is formed. When the amount is larger than 70% by weight, the amount of the binder resin in the composition is insufficient and, therefore, a mechanical strength on printing of the composition itself is decreased. Further, the proportion of the mercaptoarylimidazole compound or mercaptoarylthiazole compound (b) to the phthalocyanine compound (a) is 0.05- to 20-fold amount, preferably 0.2- to 5-fold amount. When it is smaller than 0.05-fold, charge transferring efficiency is drastically decreased and, therefore, photosensitivity becomes insufficient. When it exceeds 20-fold, a dark decay rate is increased and, therefore, it becomes difficult to preserve an electrostatic latent image for a long period of time.

In case of adding the component (d), the proportion of at least one sort of the compound selected from the group consisting of a condensed polycyclic compound, a bisazo compound, a cyanine compound and a quinacridone compound to the phthalocyanine compound (a) is similarly 0.05to 20-fold amount, preferably 0.2- to 5-fold amount. When it is smaller than 0.05-fold, the residual potential after light irradiation is increased and, therefore, a clear toner image can not be obtained. When it exceeds 20-fold, a dark decay rate is increased and, therefore, it becomes difficult to preserve an electrostatic latent image for a long period of time.

Further, in the present invention, in order to improve photosensitivity, a thiourea compound represented by the following formula:

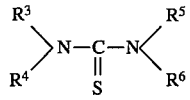

(IX)

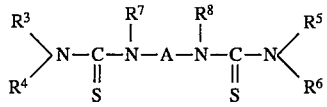

(X)

wherein $R^3$, $R^4$, $R^5$ and $R^6$ are the same or different and indicate an alkyl group having 1 to 6 carbon atoms and an aryl group having 6 to 12 carbon atoms; $R^7$ and $R^8$ are the same or different and indicate hydrogen, an alkyl or phenyl group having 1 to 5 carbon atoms; and A is a phenylene group or a polymethylene or alkylene group having 1 to 18 carbon atoms (Japanese Patent Application Ser. No. 5-222605 corresponding to U.S. Ser. No. ) may be formulated in a suitable amount as the hole transferring substance.

Examples of the thiourea compound corresponding to the formula (IX) include alkylthiourea compounds such as N,N'-dimethylthiourea, N,N'-diethylthiourea, N,N'-dipropylthiourea, N,N'-3-dibutylthiourea, trimethylthiourea, tetramethylthiourea, etc.; phenylthiourea compounds such as 1-phenylthiourea, 1-(o-tryl)thiourea, 1-(p-tryl)thiourea, 1-(p-methoxyphenyl) thiourea, 1-(p-ethoxyphenyl)thiourea, 1-(o-chlorophenyl)thiourea, 1-(mchlorophenyl) thiourea, 1-(p-chlorophenyl)thiourea, 1-(3,4-dichlorophenyl) thiourea, N-benzoyl-N'-phenylthiourea, 1-(p-methylsulfonyl)thiourea, N,N'diphenylthiourea, N,N'-di(o-tryl)thiourea, N,N'-di(p-tryl)thiourea, N,N'-diethyl-N,N'-diphenylthiourea, etc.; naphthylthiourea compounds such as N-phenyl-N'naphthylthiourea, N,N'-dinaphthylthiourea, etc.

Examples of the thiourea compound corresponding to the formula (X) include bisthiourea compounds such as N,N'-bis(phenylthiocarbamoyl)- 1,4-phenylenediamine, N,N'-bis(p-chlorophenylthiocarbamoyl)- 1,4-phenylenediamine, N-(p-chlorophenylthiocarbamoyl)-N'-(phenylthiocarbamoyl)-1,4-phenylenediamine, N,N'-bis(p-bromophenylthiocarbamoyl)-1,4-phenylenediamine, N-(p-chlorophenylthiocarbamoyl)-N'-(p-bromophenylthiocarbamoyl)-1,4-phenylenediamine, N-(p-methylphenylthiocarbamoyl)-N'-(p-cyanophenylthiocarbamoyl)-1,4-phenylenediamine, N-(p-ethylphenylcarbamoyl)-N'-(p-nitrophenylthiocarbamoyl)-1,4-phenylenediamine, N,N'-diethyl-N,N'-bis[N-ethyl-N-(p-chlorophenyl) thiocarbamoyl]- 1,4-phenylenediamine, N,N'-bis(phenylthiocarbamoyl) ethylenediamine, N,N'-bis(p-chlorophenylthiocarbamoyl)ethylenediamine, N,N'-bis(p-bromophenylthiocarbamoyl)ethylenediamine, N,N'-bis(pchlorophenylthiocarbamoyl)hexamethylenediamine, N,N'-bis(pcyanophenylthiocarbamoyl-)hexamethylenediamine and the like. Among the above thiourea compounds, preferred for the present invention are phenylthiourea, naphthylthiourea and a bisthiourea compound having an aromatic ring in a molecule. Further, additives such as conventional sensitizers, plasticizers, etc. can be used, in addition to the above.

The photosensitive resin composition of the present invention may be produced by adding the above compounds (a) and (b) or (a), (b) and (d) to a solution of a binder resin (c) dissolved in a suitable organic solvent to disperse the compounds uniformly using a normal dispersing equipment such as paint shaker, ball mill, sand mill, atriter, etc., applying the solution on a conductive substrate, followed by drying with heating. The application is normally conducted using a doctor blade, a bar coater (wire bar), a roll coater and the like.

Examples of the suitable solvent used when preparing the composition of the present invention include aromatic hydrocarbons such as benzene, toluene, xylene, etc.; ketones such as acetone, methyl ethyl ketone, methyl isobutyl ketone, etc.; ethers and cyclic ethers such as ethyl ether, tetrahydrofuran, 1,4-dioxane, etc.; esters such as ethyl acetate, butyl acetate, etc.; cellosolves (ethylene glycol monoalkyl ethers) such as methyl cellosolve, ethyl cellosolve, butyl cellosolve, etc.; or a mixture thereof.

The photosensitive resin plate of the present invention comprises a photosensitive layer of the above composition provided on a conductive substrate. The thickness of the photosensitive layer may be 1 to 20 μm, preferably 2 to 10 μm, in case of a single layer type. In case of a multi-layer type, a charge generating layer (CGL) containing at least one sort of a compound selected from a phthalocyanine compound (charge generating substance) and a condensed polycyclic quinone compound, a bisazo compound, a cyanine compound and a quinacridone compound is formed on a substrate, and a charge transferring layer (CTL) containing a hole transferring substance (mercaptoarylimidazole compound or mercaptoarylthiazole compound) is further formed thereon. In this case, the thickness of CGL is 0.01 to 5 μm, preferably 0.1 to 2 μm and, further, the thickness of CTL is 1 to 15 μm, preferably 2 to 8 μm.

When the thickness of the photosensitive layer is thin, deviating from the above proper range, a surface potential of the photosensitive material becomes low and only a small amount of a toner is adhered to the printing part after toner developing. Therefore, a perfect film of the toner image is not formed after fixing and a part containing no toner (e.g. fine cavity, pinhole, etc.) is arisen at the printing part. Accordingly, when a printing plate is produced by dissolving/removing the non-printing part of the photosensitive material with an alkali aqueous solution, the alkali aqueous solution penetrates through the cavity or pinhole of the toner image to dissolve/remove the photosensitive layer of the printing part partially, and it is not preferred.

When the thickness of the photosensitive layer is thick, deviating from the above proper range, a perfect film of the toner image can be formed on the photosensitive material. However, it takes a long time to dissolve the non-printing part of the photosensitive material with the alkali aqueous solution and the photosensitive layer of the printing part (e.g. fine line, halftone dot, etc.) is also removed by side-etching, and it is not preferred.

After the above photosensitive resin composition is applied on the substrate, the coated substrate is dried to give a photosensitive layer. Regarding the drying condition, the heating temperature is 40° to 200° C., preferably 70° to 150° C. Further, the drying time varies depending upon the drying temperature, but is preferably about 1 to 30 minutes. When the drying is conducted at the temperature and time which are smaller than the above range, a large amount of the residual solvent is remained in the photosensitive layer and, therefore, corona charge properties as well as charge retention due to dark decay rate are deteriorated. Further, when the drying is conducted at the temperature and time which are larger than the above range, the photosensitive layer welds to the substrate due to high temperature, or the polymerization reaction due to a non-reacted functional group in the binder resin is accelerated, or change in crystal form of phthalocyanine is arisen, thereby causing deterioration of alkali-eluation properties, deterioration of charging characteristics and photosensitivity and the like.

As the substrate of the printing plate of the present invention, for example, there can be used a plate or foil (e.g. aluminum plate), a plastic film on which metals such as aluminum is coated or a paper which has been subjected to a conductive treatment. The substrates are used after subjecting to a hydrophilization treatment. Among these substrates, an aluminum plate is suitably used.

As the method of the hydrophilization treatment on the surface of the aluminum plate, there can be used a known method such as sand dressing method, anodizing method and the like. Examples of the sand dressing method include mechanical roughening method, electrochemical roughening method, chemical surface selective dissolution method and the like. As the mechanical roughening method, there can be used a known method such as ball polishing method, brush polishing method, blast polishing method, buffing method and the like. Further, the electrochemical roughening method include a method of polishing with applying an AC or DC voltage in an electrolyte solution of hydrochloric acid or nitric acid.

The aluminum plate which has been subjected to the above treatment is subjected to the anodizing treatment. As the electrolyte in the anodizing treatment, there can be used sulfuric acid, phosphoric acid, oxalic acid or a mixed acid thereof. The concentration of the electrolyte is suitably selected by the kind of the electrolyte. The coating weight of the anodized film may be 0.10 to 10 g/m$^2$, preferably 0.5 to 5.0 g/m$^2$. Further, a plate which is subjected to an electrodeposition treatment using an aqueous alkali metal silicate salt solution after anodizing treatment is also used as the suitable substrate.

Regarding three component ((a)+(b)+(c)) system, it is assumed that, by irradiating semi-conductor laser light having a wavelength of 780 nm to the composition after negative corona charging, a phthalocyanine compound as a photocharging substance is excited, thereby emitting electrons. Thus, the mercaptoarylimidazole compound or mercaptoarylthiazole compound enables the resultant holes of phthalocyanine to transfer to the surface of the photosensitive layer effectively, thereby neutralizing a negative charge of the surface of the photosensitive layer efficiently.

Regarding four component ((a)+(b)+(c)+(d)) system, it is assumed that, by irradiating white light, He-Ne laser light or semi-conductor laser light to the composition after negative corona charging, at least one sort of a compound selected from a phthalocyanine compound or a condensed polycyclic quinone compound as a photocharging substance, a bisazo compound, a cyanine compound and a quinacridone compound is excited, thereby causing energy transference with electron transferring reaction to follow. It is assumed that the mercaptoarylimidazole compound or mercaptoarylthiazole compound serves as an electron donative substance to the resultant holes of phthalocyanine, which enables the holes to transfer to the surface of the photosensitive layer effectively, thereby neutralizing a negative charge of the surface of the photosensitive layer efficiently. Therefore, it is possible to decrease the residual potential of the surface of the photosensitive layer after exposure, thereby decreasing the adhesion of toner at the non-printing part. As a result, the non-image area is dissolved easily and completely when the alkali eluation of the toner image is conducted. Accordingly, it is possible to obtain a more clear printed image in comparison with the above three component system.

In the four component system, it becomes possible to use not only semi-conductor laser light having a wavelength of 780 nm corresponding to the absorption wavelength of phthalocyanine as described above, but also visible light having a wavelength within a wide range of 400 nm to 700 nm corresponding to the absorption wavelength of the component (d). Further, in the present invention, by using image data composed for the respective color printings (e.g. yellow printing, magenta printing, cyane printing, black printing, etc.) incorporated from a color scanner at the time of scanning exposure due to semi-conductor laser as a modulation signal, a lithographic printing plate for each color used for color printing can be easily produced. A color printed product can be obtained by printing while adjusting a register of the lithographic printing plate for each color.

According to the present invention, there is provided a photosensitive resin composition for negative charging, which exhibits high sensitivity within a visible/infrared range, particularly a semi-conductor laser light wavelength range (780 nm), and a printing original plate which exhibits a low residual potential after light irradiation, thereby affording a toner image having high resolving power. Further, if the above printing original plate is used, there can be obtained a printed product having high quality without causing no scumming in case of printing.

EXAMPLES

The following Production Examples, and Comparative Examples further illustrate the present invention in detail but are not to be construed to limit the scope thereof. In Production Examples, Examples and Comparative Examples, all "parts" are by weight unless otherwise stated.

Production Example 1 (Synthetic Example of binder resin)

To a 1 liter flask equipped with a stirrer, a Dimroth condenser and a nitrogen introducing tube, 200 parts of ethyl cellosolve was charged in advance and heated to 85° C. Then, a solution prepared by mixing and dissolving 44.8 parts of isobutyl methacrylate, 40.6 parts of ethyl methacrylate, 53.2 parts of n-butyl methacrylate, 61.4 parts of methacrylic acid and 1.4 parts of a radical polymerization initiator V-59 (2,2'-azobis(2-methylbutyronitrile), manufactured by Wako Junyaku Co., Ltd.) was added dropwise in the flask from a dropping funnel over 3 hours. Further, the mixture was heated for 3 hours to complete the solution polymerization reaction. The resulting resin had a solid content of 50%, a number-average molecular weight of 22,000, a weight-average molecular weight of 62,500 and an acid value of 200.

Example 1

10 Parts of octafiuoro-octakis(phenylthio)zinc phthalocyanine (manufactured by Nihon Shokubai Co., Ltd.), 10 parts of mercaptobenzimidazole and 100 parts of a resin solution synthesized in Production Example 1 were dispersed in 300 parts of a mixed solvent (xylene/ethyl cellosolve = 1/1 (w/w)). Then, the mixture was charged in a vessel together with a suitable amount of beads to prepare a paint for photosensitive layer using a paint shaker. This paint was applied on an aluminum plate, of which surface was subjected to a hydrophilization treatment in advance, using a wire bar (bar coater), followed by drying at 100° C. for 25 minutes to prepare an electrographic lithographic printing plate having a photosensitive layer of 5 μm in film thickness. Charging characteristics and photosensitivity of the printing original plate were measured using a "paper analyzer EPA-8200" manufactured by Kawaguchi Denki Co., Ltd. A surface potential $V_o$ (V) of the photosensitive material immediately after application of a corona charge voltage of −7.5 KV and a surface potential $V_{10}$ (V) at the time at which 10 seconds have passed since the beginning of application of voltage were measured, and charge retention of the printing original plate (in case of dark state) was evaluated by the value of $V_{10}$ (V)/$V_o$ (V). Monochromatic light of 780 nm obtained from white light through a filter was irradiated on the surface of the charged printing original plate to measure photosensitivity. A dose of exposure $E_{1/2}$ (Lux.Sec) which is necessary for the surface potential after exposure to be reduced to half of the initial surface potential and a residual potential $VR_{40}$(V) at the time at which 40 seconds have passed since the beginning of exposure were measured by using a light intensity of 1.4 Lux. Charging characteristics and photosensitivity of the printing original plate were evaluated according to these measurement values. The results are shown in Table 1.

Example 2

10 Parts of octafluoro-octakis(phenylthio)zinc phthalocyanine (manufactured by Nihon Shokubai Co., Ltd.), 20 parts of mercaptomethylbenzimidazole and 100 parts of a resin solution synthesized in Production Example 1 were dispersed in 340 parts of a mixed solvent described in Example 1. Then, according to the same manner as that described in Example 1, a paint was prepared and charging characteristics and photosensitivity of the sample prepared by applying the paint on a substrate and drying were measured. The results are also shown in Table 1.

Example 3

10 Parts of octafluoro-octakis(phenylthio)zinc phthalocyanine (manufactured by Nihon Shokubai Co., Ltd.), 10 pads of mercaptobenzothiazole and 140 parts of a resin solution synthesized in Production Example 1 were dispersed in 370 pads of a mixed solvent described in Example 1. Then, according to the same manner as that described in Example 1, a paint was prepared and charging characteristics and photosensitivity of the sample prepared by applying the paint on a substrate and drying were measured. The results are also shown in Table 1.

Example 4

10 Parts of fastgen blue 8120B (X-type metal-free phthalocyanine, manufactured by Dainihon Ink Co., Ltd.), 10 parts of mercaptonaphthoimidazole and 100 pads of a resin solution synthesized in Production Example 1 were dispersed in 290 pads of a mixed solvent described in Example 1. Then, according to the same manner as that described in Example 1, a paint was prepared and charging characteristics and photosensitivity of the sample prepared by applying the paint on a substrate and drying were measured. The results are also shown in Table 1.

Example 5

10 Parts of fastgen blue 8120B (X-type metal-free phthalocyanine, manufactured by Dainihon Ink Co., Ltd.), 10 parts of mecaptohydroxybenzimidazole and 100 parts of a resin solution synthesized in Production Example 1 were dispersed in 290 pads of a mixed solvent described in Example 1. Then, according to the same manner as that described in Example 1, a paint was prepared and charging characteristics and photosensitivity of the sample prepared by applying the paint on a substrate and drying were measured. The results are also shown in Table 1.

Example 6

10 Parts of phthalocyanine T-22 (titanyl phthalocyanine, manufactured by Sanyo Shikiso Co., Ltd.), 8 parts of mercaptonaphthothiazole and 140 pads of a resin solution synthesized in Production Example 1 were dispersed in 360 parts of a mixed solvent described in Example 1. Then, according to the same manner as that described in Example 1, a paint was prepared and charging characteristics and photosensitivity of the sample prepared by applying the paint on a substrate and drying were measured. The results are also shown in Table 1.

Example 7

10 Parts of β-type copper phthalocyanine, 5 parts of mercaptodihydroxybenzothiazole and 140 pads of a resin solution synthesized in Production Example 1 were dispersed in 345 pads of a mixed solvent described in Example 1. Then, according to the same manner as that described in Example 1, a paint was prepared and charging characteristics and photosensitivity of the sample prepared by applying the paint on a substrate and drying were measured. The results are also shown in Table 1.

Example 8

8 Parts of octafluoro-octakis(phenylthio)zinc phthalocyanine (manufactured by Nihon Shokubai Co., Ltd.), 10 parts of mecaptobenzoimidazole, 2 parts of an adduct of pyranthrone orange with 3 to 4 bromo groups and 100 parts of a resin solution synthesized in Production Example 1 were dispersed in 290 pads of a mixed solvent described in Example 1. Then, charging characteristics and photosensitivity of the sample prepared by applying the resulting paint on a substrate and drying were measured. The results are shown in Table 2.

Example 9

8 Parts of fastgen blue 8120B (X-type metal-free phthalocyanine, manufactured by Dainihon Ink Co., Ltd.), 10 parts of mercaptobenzothiazole, 5 pads of anzanthrone and 120 parts of a resin solution synthesized in Production Example 1 were dispersed in 345 parts of a mixed solvent described in Example 1. Then, charging characteristics and photosensitivity of the sample prepared by applying the resulting paint on a substrate and drying were measured. The results are shown in Table 2.

Example 10

10 Parts of octafluoro-octakis(phenylthio)zinc phthalocyanine (manufactured by Nihon Shokubai Co., Ltd.), 3 parts of pyranthrone orange, 3 parts of mercaptobenzimidazole and 80 parts of a resin solution synthesized in Production Example 1 were dispersed in 220 parts of a mixed solvent described in Example 1. Then, according to the same manner as that described in Example 1, a paint was prepared and the paint was applied on a substrate and dried to form a film having a thickness of 1 μm as a charge generating layer (CGL). Then, 20 pads of mercaptobenzimidazole and 100 parts of a resin solution synthesized in Production Example 1 were dispersed in 290 pads of a mixed solvent described in Example 1. Then, according to the same manner as that described in Example 1, a paint was prepared and the paint was applied on the layer of CGL and dried to form a film having a thickness of 4 μm as a charge transferring layer (CTL), thereby affording a photosensitive layer having a thickness of 5 μm. According to the same manner as that described in Example 1, charging characteristics and photosensitivity of the sample thus obtained were measured. The results are shown in Table 1.

Example 11

According to the same manner as that described in Example 1 except for irradiating white light (tungsten lamp light) to a printing original plate obtained in Example 8, charging characteristics and photosensitivity were measured. The results are shown in Table 4.

Example 12

According to the same manner as that described in Example 1 except for irradiating white light (tungsten lamp light) to a printing original plate obtained in Example 9, charging characteristics and photosensitivity were measured. The results are shown in Table 4.

Example 13

10 Parts of octafluoro-octakis(phenylthio)zinc phthalocyanine (manufactured by Nihon Shokubai Co., Ltd.), 10 parts of mercaptomethylbenzimidazole, 2 parts of a bisazo compound having a structure of the following formula and 100 parts of a resin solution synthesized in Production Example 1 were dispersed in 300 parts of a mixed solvent described in Example 1. Then, according to the same manner as that described in Example 1, a paint was prepared and charging characteristics and photosensitivity of the sample prepared by applying the paint on a substrate and drying were measured. The results are shown in Table 5.

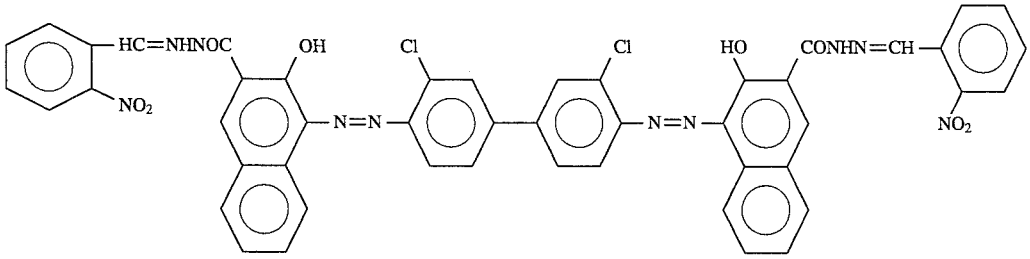

results are shown in Table 2.

Example 14

10 Parts of octafluoro-octakis(phenylthio)zinc phthalocyanine (manufactured by Nihon Shokubai Co., Ltd.), 10 parts of mercaptonaphthothiazole, 10 parts of a cyanine bisazo compound having a structure of the following formula and 100 parts of a resin solution synthesized in Production Example 1 were dispersed in 340 parts of a mixed solvent described in Example 1. Then, according to the same manner as that described in Example 1, a paint was prepared and charging characteristics and photosensitivity of the sample prepared by applying the paint on a substrate and drying were measured. The results are also shown in Table 5.

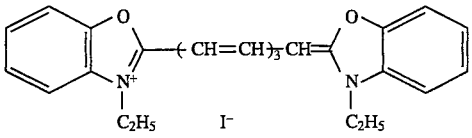

Example 15

10 Parts of octafluoro-octakis(phenylthio)zinc phthalocyanine (manufactured by Nihon Shokubai Co., Ltd.), 5 parts of mercaptotetrahydroxybutylphenylimidazole, 3 parts of a quinacridone compound having a structure of the following formula and 100 parts of a resin solution synthesized in Production Example 1 were dispersed in 280 parts of a mixed solvent described in Example 1. Then, according to the same manner as that described in Example 1, a paint was prepared and charging characteristics and photosensitivity of the sample prepared by applying the paint on a substrate and drying were measured. The results are also shown in Table 5.

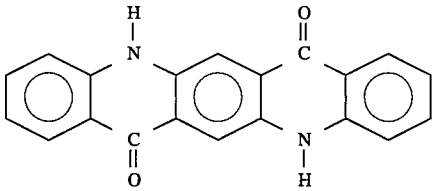

(C.I. Pigment Violet 19)

Example 16

10 Parts of octafluoro-octakis(phenylthio)zinc phthalocyanine (manufactured by Nihon Shokubai Co., Ltd.), 5 pads of N,N'-diphenylthiourea, 5 parts of mercaptobenzimidazole and 100 parts of a resin solution synthesized in Production Example 1 were dispersed in 290 parts of a mixed solvent described in Example 1. Then, according to the same manner as that described in Example 1, a paint was prepared and charging characteristics and photosensitivity of the sample prepared by applying the paint on a substrate and drying were measured. The results are shown in Table 1.

Example 17

By using a scanning exposure type platemaking machine "1440EZ plate setter" (manufactured by Print Wear Co., U.S.A) equipped with a semiconductor laser having a wavelength of 780 nm as a light source and a liquid developer (positive charge toner for 1440EZ, manufactured by Print Wear Co., U.S.A), a toner image was formed on a printing original plate prepared in Example 1 by operations such as charging, exposure, liquid developing and fixing. Thereafter, a photosensitive layer of the non-printing part on which no toner was adhered was dissolved/removed with an alkali developing solution (developer for 1440 EZ, manufactured by Print Wear Co., U.S.A.) and was subjected to a protective treatment with a gum solution to prepare a lithographic printing plate wherein the toner image was remained as the printing part.

The respective printing plates thus obtained were attached to a portable offset printing machine, Hamadastar 7000CDX manufactured by Hamada Insatsu Kikai Seisakusho Co., Ltd. to print on a fine-quality paper with commercially available ink. As a result, fifty thousand copies could be printed satisfactorily without causing scumming of the non-printing part by using any printing plate.

Example 18

By using a laser platemaking machine equipped with a He-Ne laser having a wavelength of 633 nm as a light source, and a liquid developer, a toner image was formed on a printing original plate prepared in Example 8 by operations such as charging, exposure, liquid developing and fixing. Thereafter, a photosensitive layer of the non-printing part on which no toner was adhered was dissolved/removed with an alkali developing solution to prepare a lithographic printing plate wherein the toner image was remained as the printing part.

The respective printing plates thus obtained were attached to a portable offset printing machine, Hamadastar 7000CDX manufactured by Hamada Insatsu Kikai Seisakusho Co., Ltd. to print on a fine-quality paper with commercially available ink. As a result, one hundred thousand copies could be printed satisfactorily without causing scumming of the non-printing part by using any printing plate.

Comparative Example1

8 Parts of octafluoro-octakis(phenylthio)zinc phthalocyanine (manufactured by Nihon Shokubai Co., Ltd.), 10 parts of mercaptobenzimidazole and 100 parts of a resin solution synthesized in Production Example 1 were dispersed in 280 parts of a mixed solvent described in Example 1. Then, charging characteristics and photosensitivity of the sample prepared by applying the resulting paint on a substrate and drying were measured. The results are shown in Table 2.

Comparative Example 2

8 Parts of octafluoro-octakis(phenylthio)zinc phthalocyanine (manufactured by Nihon Shokubai Co., Ltd.), 10 parts of an adduct of pyranthrone orange with 3 to 4 bromo groups and 100 parts of a resin solution synthesized in Production Example 1 were dispersed in 280 parts of a mixed solvent described in Example 1. Then, charging characteristics and photosensitivity of the sample prepared by applying the resulting paint on a substrate and drying were measured. The results are shown in Table 2.

Comparative Example 3

8 Parts of octafluoro-octakis(phenylthio)zinc phthalocyanine (manufactured by Nihon Shokubai Co., Ltd.) and 100 parts of a resin solution synthesized in Production Example 1 were dispersed in 233 parts of a mixed solvent described in Example 1. Then, charging characteristics and photosensitivity of the sample prepared by applying the resulting paint on a substrate and drying were measured. The results are shown in Table 2.

Comparative Example 4

8 Parts of fastgen blue 8120B (X-type metal-free phthalocyanine, manufactured by Dainihon Ink Co., Ltd.), 10 parts of mercaptobenzothiazole and 120 parts of a resin solution synthesized in Production Example 1 were dispersed in 295 parts of a mixed solvent described in Example 1. Then, charging characteristics and photosensitivity of the sample prepared by applying the resulting paint on a substrate and drying were measured. The results are shown in Table 2.

Comparative Example 5

8 Parts of fastgen blue 8120B (X-type metal-free phthalocyanine, manufactured by Dainihon Ink Co., Ltd.), 5 parts of anzanthrone and 120 parts of a resin solution synthesized in Production Example 1 were dispersed in 295 parts of a mixed solvent described in Example 1. Then, charging characteristics and photosensitivity of the sample prepared by applying the resulting paint on a substrate and drying were measured. The results are shown in Table 2.

Comparative Example 6

8 Parts of fastgen blue 8120B (X-type metal-free phthalocyanine, manufactured by Dainihon Ink Co., Ltd.) and a resin solution synthesized in Production Example 1 were dispersed in 272 parts of a mixed solvent described in Example 1. Then, charging characteristics and photosensitivity of the sample prepared by applying the resulting paint on a substrate and drying were measured. The results are shown in Table 2.

Comparative Example 7

According to the same manner as that described in Example 1 except for using the same amount of benzimidazole as a hole transferring substance in place of mercaptobenzimidazole of Example 1, a sample was obtained and its charging characteristics and photosensitivity were measured. The results are shown in Table 3.

Comparative Example 8

According to the same manner as that described in Example 3 except for using the same amount of benzthiazole as a hole transferring substance in place of mercaptobenzoimidazole of Example 3, a sample was obtained and its charging characteristics and photosensitivity were measured. The results are shown in Table 3.

Example 19

10 Parts of octafluoro-octakis(phenylthio)zinc phthalocyanine (manufactured by Nihon Shokubai Co., Ltd.), 5 parts of N,N'-diphenylthiourea, 5 parts of mercaptobenzimidazole, 2 parts of an adduct of pyranthrone orange with 3 to 4 bromo groups and 100 parts of a resin solution synthesized in Production Example 1 were dispersed in 300 parts of a mixed solvent described in Example 1. Then, according to the same manner as that described in Example 1, a paint was prepared and charging characteristics and photosensitivity of the sample prepared by applying the paint on a substrate and drying were measured. The results are shown in Table 1.

Example 20

10 Parts of octafluoro-octakis(phenylthio)zinc phthalocyanine (manufactured by Nihon Shokubai Co., Ltd.), 5 pads of N,N'-di(o-tolyl)thiourea, 5 parts of mercaptobenzimidazole, 3 parts of flavanthrone and 100 parts of a resin solution synthesized in Production Example 1 were dispersed in 305 parts of a mixed solvent described in Example 1. Then, according to the same manner as that described in Example 1, a paint was prepared and charging characteristics and photosensitivity of the sample prepared by applying the paint on a substrate and drying were measured. The results are shown in Table 1.

Example 21

By using a scanning exposure type platemaking machine "1440EZ plate setter" (manufactured by Print Wear Co., U.S.A) equipped with a semiconductor laser having a wavelength of 780 nm as a light source and a liquid developer (positive charge toner for 1440EZ, manufactured by Print Wear Co., U.S.A), a toner image was formed on a printing original plate prepared in Example 19 by operations such as charging, exposure, liquid developing and fixing. Thereafter, a photosensitive layer of the non-printing part on which no toner was adhered was dissolved/removed with an alkali developing solution (developer for 1440 EZ, manufactured by Print Wear Co., U.S.A.) and was subjected to a protective treatment with a gum solution to prepare a lithographic printing plate wherein the toner image was remained as the printing part.

The respective printing plates thus obtained were attached to a portable offset printing machine, Hamadastar 7000CDX manufactured by Hamada Insatsu Kikai Seisakusho Co., Ltd. to print on a fine-quality paper with commercially available ink. As a result, one hundred thousand copies could be printed satisfactorily without causing scumming of the non-printing part by using any printing plate.

Example 22

By using a laser platemaking machine equipped with a He-Ne laser having a wavelength of 633 nm as a light source, and a liquid developer, a toner image was formed on a printing original plate prepared in Example 19 by operations such as charging, exposure, liquid developing and fixing. Thereafter, a photosensitive layer of the non-printing part on which no toner was adhered was dissolved/removed with an alkali developing solution to prepare a lithographic printing plate wherein the toner image was remained as the printing part. The respective printing plates thus obtained were attached to a portable offset printing machine, Hamadastar 7000CDX manufactured by Hamada Insatsu Kikai Seisakusho Co., Ltd. to print on a fine-quality paper with commercially available ink. As a result, one hundred thousand copies could be printed satisfactorily without causing scumming of the non-printing part by using any printing plate.

Comparative Example 9

According to the same manner as that described in Example 8 except for using the same amount of benzimidazole as a hole transferring substance in place of mercaptobenzimidazole of Example 8, a sample was obtained and its charging characteristics and photosensitivity were measured. The results are shown in Table 3.

Comparative Example 10

According to the same manner as that described in Example 3 except for using the same amount of benzthiazole as a hole transferring substance,in place of mercaptobenzthiazole of Example 9, a sample was obtained and its charging characteristics and photosensitivity were measured. The results are shown in Table 3.

| | $V_0$ (V) | $V_{10}$ (V) | $V_{10}/V_0$ (%) | $E_{1/2}$ (Lux · Sec) | $V_{R40}$ (V) |
|---|---|---|---|---|---|
| Example 1 | −380 | −342 | 90.0 | 0.71 | −5 |
| Example 2 | −360 | −328 | 91.2 | 0.75 | −4 |
| Example 3 | −395 | −352 | 89.0 | 0.77 | −5 |
| Example 4 | −378 | −333 | 88.0 | 1.03 | −7 |
| Example 5 | −383 | −334 | 87.3 | 1.10 | −8 |
| Example 6 | −365 | −296 | 81.0 | 0.99 | −8 |
| Example 7 | −415 | −299 | 72.0 | 2.41 | −10 |
| Example 10 | −397 | −359 | 90.4 | 0.48 | −1 |
| Example 16 | −395 | −356 | 90.1 | 0.65 | −3 |
| Example 19 | −395 | −357 | 90.4 | 0.49 | −1 |
| Example 20 | −390 | −353 | 90.2 | 0.51 | −1 |

| | $V_0$ (V) | $V_{10}$ (V) | $V_{10}/V_0$ (%) | $E_{1/2}$ (Lux · Sec) | $V_{R40}$ (V) |
|---|---|---|---|---|---|
| Example 8 | −403 | −364 | 90.4 | 0.50 | −1 |
| Comparative example 1 | −411 | −330 | 80.3 | 0.52 | −6 |
| Comparative example 2 | −335 | −279 | 83.4 | 1.97 | −7 |
| Comparative example 3 | −423 | −297 | 70.3 | 2.99 | −30 |
| Example 9 | −396 | −356 | 89.8 | 0.98 | −1 |
| Comparative example 4 | −413 | −290 | 70.3 | 1.01 | −7 |
| Comparative example 5 | −342 | −288 | 84.1 | 2.63 | −7 |
| Comparative example 6 | −418 | −277 | 66.3 | 3.94 | −35 |

As is apparent from Table 2, the photosensitive material comprising phthalocyanine, mercaptoarylimidazole (thiazole) and condensed polycyclic quinone compounds of the present invention were superior in charge retention due to dark decay rate and residual potential to the photosensitive material comprising phthalocyanine and mercaptoarylimidazole (thiazole) compounds. Further, the photosensitive material of the present invention was superior in photosensitivity and residual potential to the photosensitive material comprising phthalocyanine and condensed polycyclic quinone compounds. Further, it was superior in charge retention, photosensitivity and residual potential to the photosensitive material comprising only the phtahlocyanine compound.

| | $V_0$ (V) | $V_{10}$ (V) | $V_{10}/V_0$ (%) | $E_{1/2}$ (Lux · Sec) | $V_{R40}$ (V) |
|---|---|---|---|---|---|
| Example 1 | −380 | −342 | 90.0 | 0.71 | −5 |
| Comparative example 7 | −250 | −134 | 53.4 | 3.15 | −8 |
| Example 3 | −395 | −352 | 89.0 | 0.77 | −5 |
| Comparative example 8 | −316 | −191 | 60.3 | 2.39 | −13 |
| Example 8 | −403 | −364 | 90.4 | 0.50 | −1 |
| Comparative example 9 | −270 | −148 | 54.9 | 3.34 | −5 |
| Example 9 | −396 | −356 | 89.8 | 0.98 | −1 |
| Comparative example 10 | −305 | −188 | 61.5 | 2.94 | −9 |

-continued

As is apparent from Table 3, the photosensitive material comprising phthalocyanine, mercaptoarylimidazole (thiazole) and condensed polycyclic quinone compounds of the present invention was superior in initial charging potential, dark decay, photosensitivity and residual potential to the photosensitive material comprising phthalocyanine, arylimidazole (thiazole) and condensed polycyclic quinone compounds. As described above, it has been found that the mercapto group has a large effect on photoelectric characteristics in arylimidazole (thiazole).

| | $V_0$ (V) | $V_{10}$ (V) | $V_{10}/V_0$ (%) | $E_{1/2}$ (Lux · Sec) | $V_{R40}$ (V) |
|---|---|---|---|---|---|
| Example 11 | −385 | −343 | 89.1 | 0.55 | −1 |
| Example 12 | −390 | −347 | 88.9 | 1.03 | −2 |

As is apparent from Table 4, the photosensitive material of the present invention exhibited high photosensitivity even if it is exposed to white light.

| | $V_0$ (V) | $V_{10}$ (V) | $V_{10}/V_0$ (%) | $E_{1/2}$ (Lux · Sec) | $V_{R40}$ (V) |
|---|---|---|---|---|---|
| Example 13 | −395 | −342 | 86.5 | 0.74 | −1 |
| Example 14 | −388 | −331 | 85.3 | 0.77 | −3 |
| Example 15 | −391 | −344 | 88.0 | 0.81 | −2 |

As is apparent from Table 5, the photosensitive material using bisazo, cyanine and quinacridone compounds as a photoconductive substance in combination with the phthalocyanine compound was slightly inferior in charge retention due to dark decay rate and photosensitivity to the photosensitive material using the condensed polycyclic compound, but it exhibited a level of practical use.

What is claimed is:

1. A negative charging type printing photosensitive resin composition comprising:

(a) a phthalocyanine compound;

(b) at least one compound represented by the formula (I) or (II):

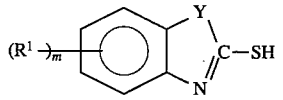

(I)

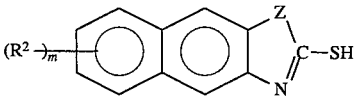

(II)

wherein Y and Z respectively indicate an imino group or a sulfur atom; $R^1$ and $R^2$ are the same or different and indicate a hydroxyl group, an alkyl group having 1 to 4 carbon atoms and a halogen atom; and m is an integer of 0 to 2; and (c) a alkali soluble binder resin.

2. The photosensitive resin composition according to claim 1, wherein the phthalocyanine compound (a) is a metallic phthalocyanine compound.

3. The photosensitive resin composition according to claim 2, wherein the metallic phthalocyanine compound is a fluorinated zinc phthalocyanine represented by the formula (III)

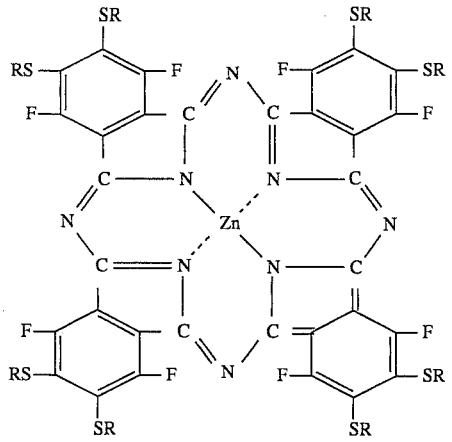

(III)

wherein R is an aryl group.

4. The photosensitive resin composition according to claim 1, wherein the phthalocyanine compound (a) is a metal-free phthalocyanine compound.

5. A negative charging type printing photosensitive resin composition comprising:

(a) a phthalocyanine compound;

(b) at least one compound represented by the formula (I) or (II):

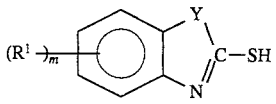

(I)

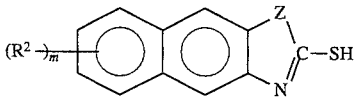

(II)

wherein Y and Z respectively indicate an imino group or a sulfur atom; $R^1$ and $R^2$ are the same or different and indicate a hydroxyl group, an alkyl group having 1 to 4 carbon atoms and a halogen atom; and m is an integer of 0 to 2;

(c) a alkali soluble binder resin; and (d) a compound selected from the group consisting of a condensed polycyclic quinone compound, a bisazo compound, a cyanine compound, a quinacridone compound and a mixture thereof.

6. The photosensitive resin composition according to claim 5, wherein the compound (d) is a condensed polycyclic quinone compound.

7. The photosensitive resin composition according to claim 6, wherein the condensed polycyclic quinone compound (d)is a compound represented by the formula (IV), (V), (VI), (VII) or (VIII):

(IV)

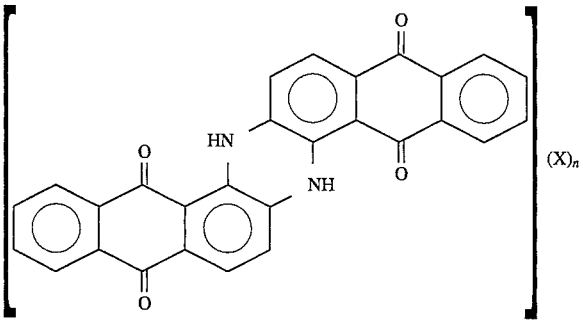

(V)

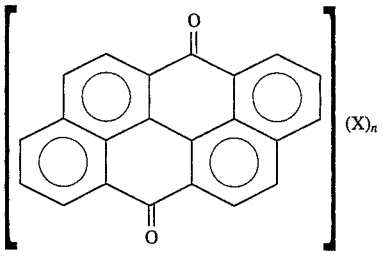

(VI)

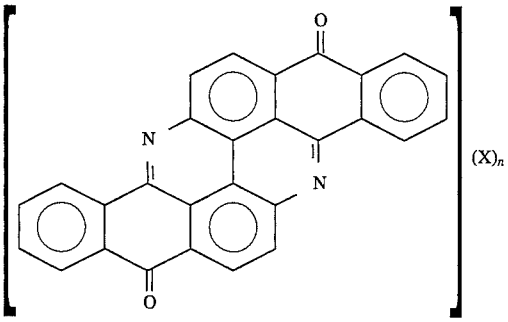

(VII)

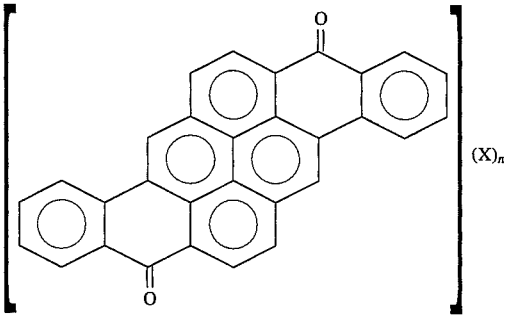

(VIII)

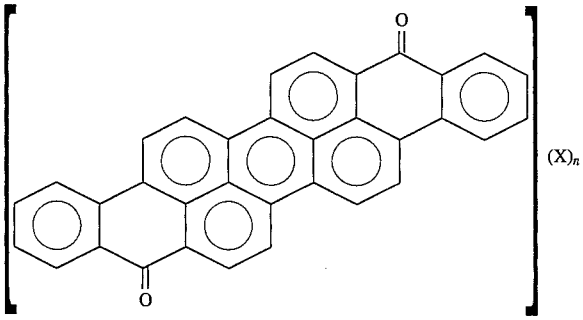

wherein X is the same or different and indicates a halogen atom and n is an integer of 0 to 4.

8. A printing photosensitive resin plate comprising a photoconductive layer formed on a conductive substrate, said photoconductive layer being composed of any one of photosensitive resin compositions of claims 1 to 7.

9. A process for producing a printing plate comprising subjecting a photosensitive layer on a hydrophilic conductive substrate to uniform negative charging, forming an electrostatic image by light exposure and toning, said photosensitive layer being composed of any one of the photosensitive resin compositions of claims 1–7.

* * * * *